US007687700B1

(12) United States Patent
Torres

(10) Patent No.: US 7,687,700 B1
(45) Date of Patent: Mar. 30, 2010

(54) ILLUMINATED DRUMSTICK

(76) Inventor: Paulo A. A. Torres, 7 Highland St., Woburn, MA (US) 01801

( * ) Notice: Subject to any disclaimer, the term of this patent is extended or adjusted under 35 U.S.C. 154(b) by 38 days.

(21) Appl. No.: 11/708,084

(22) Filed: Feb. 20, 2007

(51) Int. Cl.
*G10D 13/02* (2006.01)

(52) U.S. Cl. ..... 84/422.4; 362/34

(58) Field of Classification Search ..... 84/422.4; 362/34
See application file for complete search history.

(56) References Cited

U.S. PATENT DOCUMENTS 3,576,987 A * 5/1971 Voight et al. ..... 362/34
3,722,350 A * 3/1973 Cordes ..... 84/422.4
4,106,079 A * 8/1978 Drury ..... 362/34
4,202,241 A * 5/1980 Lucas ..... 84/422.4
4,226,163 A * 10/1980 Welcomer ..... 84/422.4
4,551,363 A * 11/1985 Fenech ..... 428/28
4,722,035 A * 1/1988 Rapisarda ..... 362/109
4,886,183 A * 12/1989 Fleming ..... 220/739
4,904,222 A * 2/1990 Gastgeb et al. ..... 446/405
5,070,435 A * 12/1991 Weller ..... 362/101
5,171,081 A * 12/1992 Pita et al. ..... 362/34
5,280,743 A * 1/1994 Abel et al. ..... 84/422.4
5,361,671 A * 11/1994 Genna ..... 84/422.4
5,415,911 A * 5/1995 Zampa et al. ..... 428/41.8
5,477,768 A * 12/1995 Swift ..... 84/453
5,696,339 A * 12/1997 Brennan ..... 84/422.4
5,931,383 A * 8/1999 Palmer et al. ..... 239/33
5,990,790 A * 11/1999 Lusareta ..... 340/571
6,028,261 A * 2/2000 Johnson ..... 84/422.4
6,207,077 B1 * 3/2001 Burnell-Jones ..... 252/301.36
6,217,187 B1 * 4/2001 Demsko ..... 362/84
6,279,180 B1 * 8/2001 Bell et al. ..... 4/661
6,423,890 B2 * 7/2002 Zbrzezny et al. ..... 84/422.4
6,423,891 B1 * 7/2002 Zengerle ..... 84/422.4
6,599,444 B2 * 7/2003 Burnell-Jones ..... 252/301.36
6,673,994 B2 * 1/2004 Broome et al. ..... 84/422.4
6,796,670 B2 * 9/2004 Winters et al. ..... 362/34
6,908,206 B1 * 6/2005 Pinciaro ..... 362/34
7,073,917 B2 * 7/2006 VanderSchuit ..... 362/96
7,216,999 B2 * 5/2007 Kaplan et al. ..... 362/34
7,312,566 B2 * 12/2007 Foo ..... 313/489
7,455,418 B1 * 11/2008 Graham ..... 362/103
2004/0025666 A1 * 2/2004 Mizuno et al. ..... 84/422.4
2004/0231493 A1 * 11/2004 Milne et al. ..... 84/422.4
2006/0027073 A1 * 2/2006 Richard ..... 84/422.4
2006/0027482 A1 * 2/2006 Pearson ..... 206/702
2006/0056167 A1 * 3/2006 Weigl, Jr. ..... 362/34
2006/0146513 A1 * 7/2006 Liu ..... 362/34
2007/0103926 A1 * 5/2007 Brooks et al. ..... 362/555
2008/0127981 A1 * 6/2008 Brooks et al. ..... 128/207.15
2008/0186694 A1 * 8/2008 Schrimmer et al. ..... 362/34

OTHER PUBLICATIONS

HipTrix™ demonstrated at the Winter NAMM 2004, invented by Erich Neugebauer, viewedSep. 8, 2008 at www.tigerbill.com/drumreviews/hiptrix.htm.*

(Continued)

*Primary Examiner*—Jeffrey Donels
*Assistant Examiner*—Robert W Horn

(57) ABSTRACT

An illuminated drumstick having a cavity therein for holding a fluorescent glow stick such that the drumstick has a dramatic visual effect when used to play a drum set.

2 Claims, 3 Drawing Sheets

OTHER PUBLICATIONS

Glow-in-the-Dark Products Manufacturer, Pete's Luminous Creations, Powder, Paint, Stickers, Tape, Pellets, Glaze, Thread and Fiber, Paper, Spray Paint, viewed by the examiner, Sep. 9, 2008.*
Glow in the Dark Paint and Power, illustrated on a model rocket © 2003 by Glow Inc., viewed at www.hobbyglow.com Sep. 9, 2008.*
Brighthandle glows, Glowing Door Handle, posted May 16, 2005 by Barb Dybwad, viewed Sep. 9, 2008 at http://www.engadget.com/2005/05/16/brighthandle-glows-green-to-indicate-unlockedness.*
Cinelli Lumen Ribbon, glow in the dark handle bar tape. viewed Jan. 27, 2009 at http://www.calhouncycle.com/productcart/pc/viewPrd.asp?idproduct=1623&IDCategory=156.*
SmartGlo Tool Bands, bands fit snugly on all hand tools, viewed Jan. 27, 2009 at http://www.smartglousa.com/tool_bands_assortment.html.*
Glow-in-the-Dark Door Knob Covers, viewed Jan. 27, 2009 at www.sightconnection.com/gldoknco.html.*

* cited by examiner

ILLUMINATED DRUMSTICK

FIELD OF THE INVENTION

The present invention generally relates to a musical instrument accessory and more particularly, relates to an illuminated drumstick of hollow construction containing an illumination source in a cavity therein.

BACKGROUND OF THE INVENTION

Drums and drumsticks are one of the most popular musical instruments in most music bands. A drumstick is normally constructed of a solid core, slender elongated body made of either plastic or wood. Such construction has been around for many years without any aesthetic improvements. It is therefore desirable to provide an improved drumstick that has more aesthetic effect and provides a more striking appearance for a musical performance.

It is therefore an object of the present invention to provide a drumstick that has improved aesthetic appearance without the drawbacks or shortcomings of the conventional drumsticks.

It is another object of the present invention to provide an illuminated drumstick that produces a stunning visual effect.

It is a further object of the present invention to provide an illuminated drumstick that has a hollow body for holding a phosphorescent glow stick therein.

SUMMARY OF THE INVENTION

In accordance with the present invention, an illuminated drumstick that contains an illumination source in a cavity of the stick is provided.

In a preferred embodiment, an illuminated drumstick can be constructed by a slender, elongated stick body that has a tapered shape, an end portion, a tip portion and a cavity therein; the body is formed of a transparent or translucent material; an opening at the end portion providing access to the cavity in the stick body and a cap for sealing the opening; and an illumination source in the cavity.

BRIEF DESCRIPTION OF THE DRAWINGS

The invention will now be described, by way of example, with reference to the accompanying drawings, in which.

DETAILED DESCRIPTION OF THE PREFERRED AND ALTERNATE EMBODIMENTS

The present invention discloses an illuminated drumstick with a cavity therein containing a phosphorescent glow stick or other illumination source.

The present invention illuminated drumstick is a novel design of an illuminated stick body for adding visual appeal to a musical performance. The illuminated drumstick can be produced from a durable, clear or translucent plastic material. Each stick measures approximately 16 inches long, about 9/16 inch in diameter around the handle or the butt end. Each stick also has an oval tip, tapered shoulder, shaft, and butt end, while the shaft containing a hollow interior. Each stick also includes a removable threaded cap on the butt end.

The present invention illuminated drumstick further includes a supply of replaceable, bendable, fluorescent glow sticks. A pair of the glow sticks can be bent or snapped to activate the phosphorescent material within the interior and then placed inside the drumstick after the caps on the ends of the stick is removed. The user can then replace the cap and use the sticks to play drums. The glow stick can be removed from the sticks interior and discarded after a performance.

In an alternate embodiment, a pair of hollow, transparent drumsticks, each having one or more battery-powered LEDs within their interiors. These lights can be activated via an on/off switch, which can be located on the butt end of the stick. The LEDs can be battery powered wherein the batteries are readily replaceable.

In another alternate embodiment of the present invention illuminated drumsticks, a series of replaceable, fluorescent/glow-in-the-dark sleeves can be slipped over the exteriors of conventional drumsticks. The sleeves can be discarded after a performance.

The present invention illuminated drumsticks can be offered in a variety of sizes and shapes, as well as with different tips. They can also be offered in a range of colors or different types of plastics that can be either transparent, substantially transparent, or translucent.

The present invention illuminated drumsticks fulfills the need for drumsticks that would add an exciting visual effect to live performances. The appealing features of the illuminated drumsticks are its ease of use, eye-catching and attractive designs, and visual appeal. The drumsticks are fabricated with a hollow interior, i.e. a cavity, that would accept a slim glow stick. Once the glow sticks are placed inside the cavity of the drumstick, an individual can play the drums in the conventional manner. A striking visual effect is thus displayed when the player used the illuminated drumsticks, especially in a dark environment.

Figure 1:
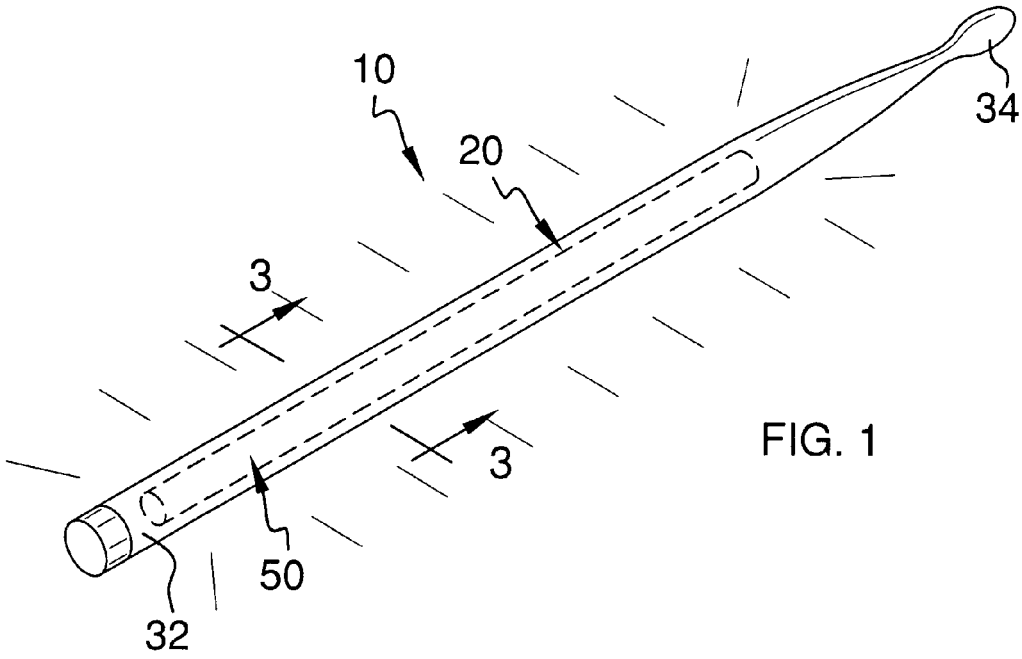
FIG. 1 is a perspective view of the present invention illuminated drumstick.

Referring initially to FIG. 1, wherein a present invention illuminated drumstick 10, is shown in a perspective view. A fluorescent stick 30, shown in ghost lines, is contained in a cavity 20 of the drumstick 10.

Figure 2:
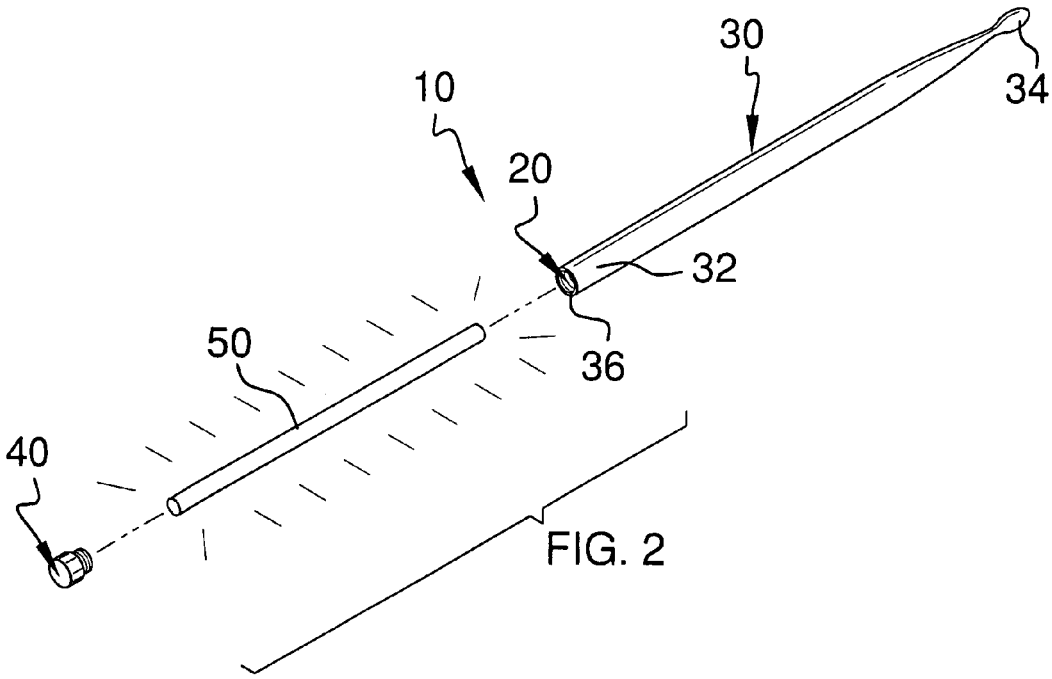
FIG. 2 is an exploded view of the present invention illuminated drumstick.

The construction of the present invention illuminated drumstick 10 is better shown in the exploded view of FIG. 2. The drumstick 10 is constructed of a slender, elongated stick body 30 that has a tapered shape, and end portion 32, a tip portion 34 and the cavity 20 contained therein. The slender, elongated stick body 30 is preferably formed of a transparent or translucent plastic material.

Figure 3:
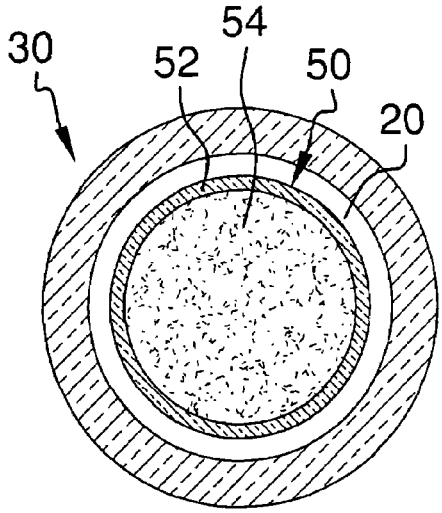
FIG. 3 is a cross-sectional view of the present invention illuminated drumstick.

An opening 36 at the end portion 32 provides access to the cavity 20 in the stick body 30 which is sealed by a cap 40 for sealing the opening 36. The fluorescent glow stick 50 as contained in the cavity 20 of the stick body 30 is better shown in an enlarged, cross-sectional view in FIG. 3. The fluorescent glow stick 50 may be formed of a shell 52 containing a fluorescent liquid 54 therein.

Figure 4:
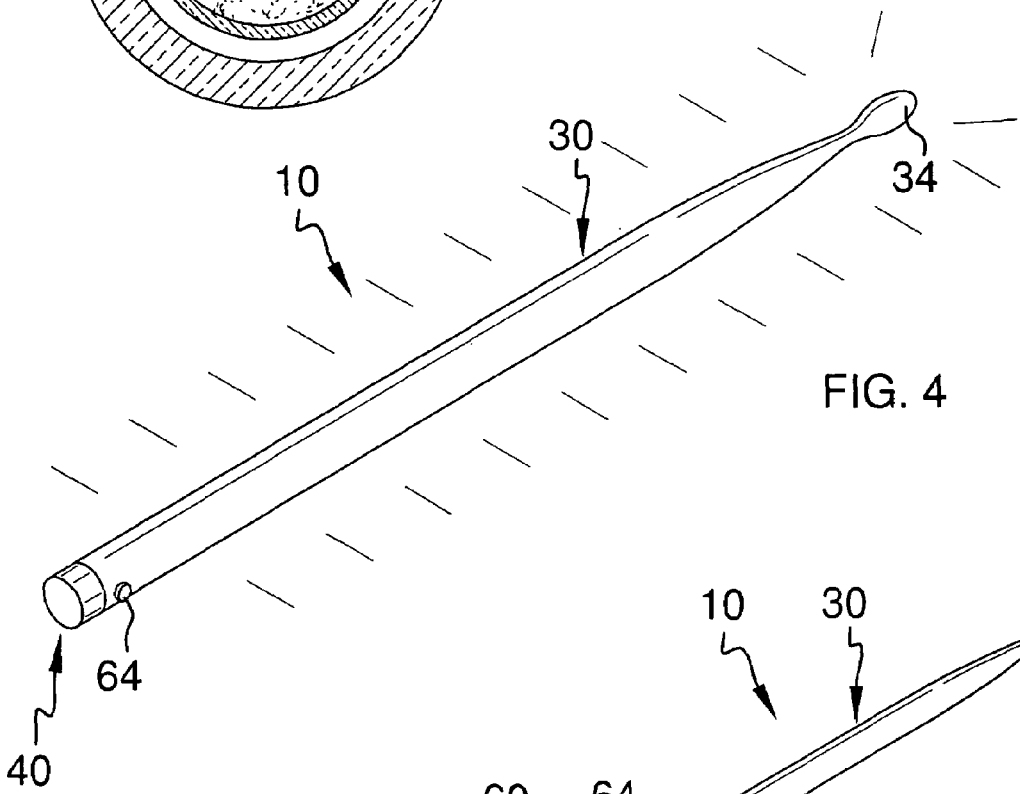
FIG. 4 is a perspective view of an alternate embodiment of the present invention illuminated drumstick.
Figure 5:
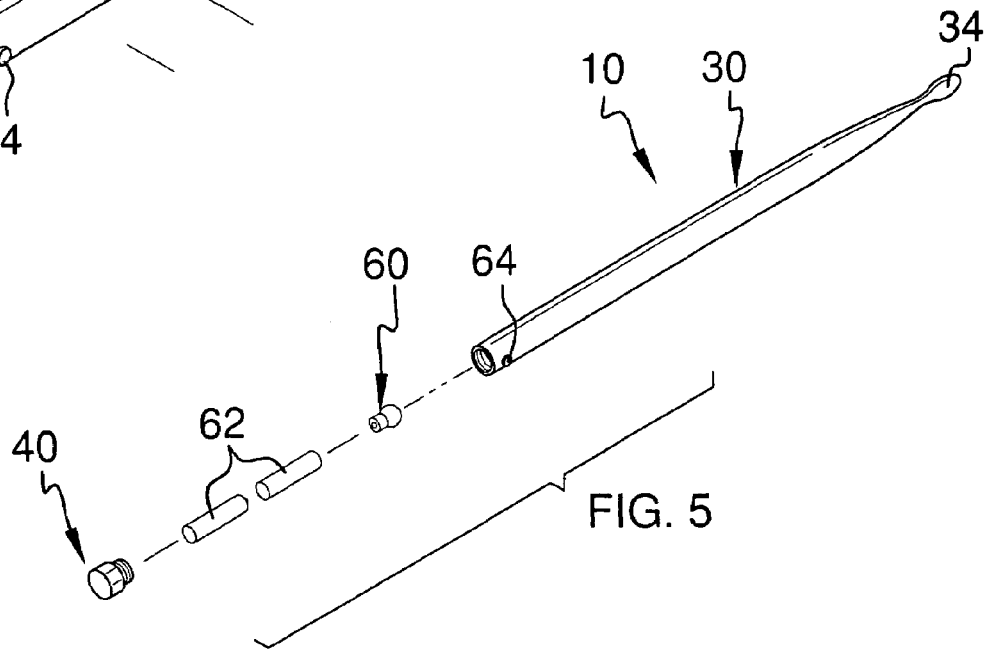
FIG. 5 is an exploded view of the present invention alternate embodiment shown in FIG. 4.
Figure 6:
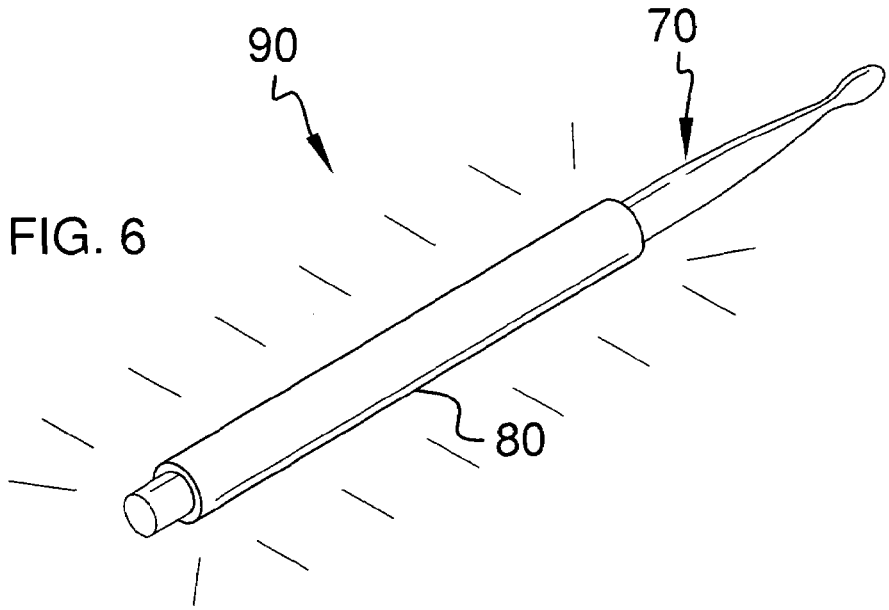
FIG. 6 is a perspective view of another alternate embodiment of the present invention illuminated drumstick.
Figure 7:
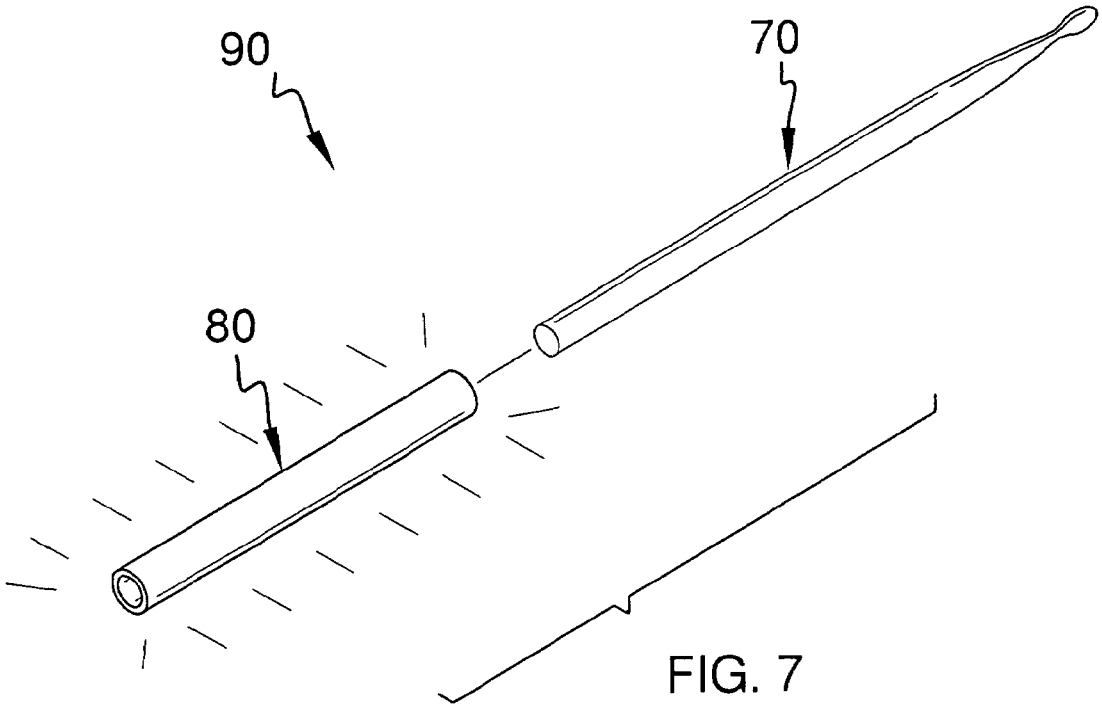
FIG. 7 is an exploded view of the other alternate embodiment shown in FIG. 6.

In an alternate embodiment, the present invention illumination source can be suitably supplied by an LED bulb 60 which is powered by replaceable batteries 62 and controlled by an on/off switch 64. This is shown in FIGS. 4 and 5. In this embodiment, the stick body is also formed of a transparent, substantially transparent, or translucent plastic material. In yet another alternate embodiment, in which a stick body 70 which has a solid core and a fluorescent sleeve 80 slipped over the outside periphery of the stick body 70 forming the drumstick 90. The fluorescent sleeve 80 may be suitably formed in an elastomeric foam material impregnated with a fluorescent dye. The elastomeric foam retains elasticity such that is can be tightly fit over the stick body 70 without falling off the stick. The fluorescent sleeve 80 can be readily replaced after it looses its illuminating appearance. This alternate embodiment is shown in FIGS. 6 and 7.

The present invention illuminated drumsticks, in three embodiments, has therefore been amply described in the above descriptions and in the appended drawings of FIGS. 1-7.

While the preferred embodiments of the invention have been described above, it will be recognized and understood that various modifications can be made in the invention and the appended claims are intended to cover all such modifications which may fall within the spirit and scope of the invention.

What is claimed is:

1. An illuminated drumstick comprising:

a slender, elongated stick body having a tapered shape, an end portion, and a tip portion; and whereby the illumination source is a replaceable fluorescent sleeve made of an elastomeric foam fitted over the outside periphery of the end portion of the stick body, said stick body is formed of a translucent plastic material.

2. The illuminated drumstick according to claim 1, wherein said stick body further comprising an oval shaped tip portion.

* * * * *